United States Patent [19]

Kosuge

[11] 4,018,018

[45] Apr. 19, 1977

[54] ARCHITECTURAL BLOCK AND THE STRUCTURE COMPOSED THEREOF

[76] Inventor: Momotoshi Kosuge, No. 834-9 Kitaishigaki, Beppu, Oita, Japan

[22] Filed: Nov. 26, 1974

[21] Appl. No.: 527,367

[30] Foreign Application Priority Data

Dec. 17, 1973 Japan ..... 48-141605

[52] U.S. Cl. ..... 52/127; 52/309.4; 52/404; 52/607

[51] Int. Cl.[2] ..... E02D 35/00

[58] Field of Search ..... 52/605, 606, 607, 612, 52/404, 405, 439, 743, 309, 127; 16/2

[56] References Cited

UNITED STATES PATENTS

| | | | |
|---|---|---|---|
| 2,172,051 | 9/1939 | Robbins | 52/405 |
| 2,578,165 | 12/1951 | Bailey | 16/2 X |
| 3,222,830 | 12/1965 | Ivany | 52/607 X |
| 3,388,509 | 6/1968 | Mora | 52/606 X |
| 3,717,967 | 2/1973 | Wood | 52/439 X |

*Primary Examiner*—Price C. Faw, Jr.
*Assistant Examiner*—Carl D. Friedman
*Attorney, Agent, or Firm*—Armstrong, Nikaido & Marmelstein

[57] ABSTRACT

The present invention provides an architectural block which comprises two opposed side walls and at least two parallel partitions positioned between the side walls perpendicular thereto. The partitions and side walls define chambers within the block, and a groove is formed in one edge of each of the partitions. The chambers are filled with a foaming agent comprising a light-weight heat insulator and moisture-proof material.

10 Claims, 8 Drawing Figures

ARCHITECTURAL BLOCK AND THE STRUCTURE COMPOSED THEREOF

BACKGROUND OF THE INVENTION

1. Field of the Invention

This invention relates to an architectural block containing holes which are filled with a heat-insulator and moisture-proof material and to a structure constructed with said blocks.

2. Description of the Prior Art

In conventional architectural blocks, it is well known to construct these blocks with chambers or holes in the center thereof. The blocks are generally made of a material such as concrete or other porous type material. One of the disadvantages with these types of blocks is that they do not provide adequate that insulation or moisture-proofing. Thus, when these blocks are used in constructing a structural member such as a wall, it is generally necessary to cover the surface with some sort of a sealing film to prevent moisture from seeping through and also to cover a surface with a layer of insulating material to prevent heat transfer through the structure. The necessity for the water-proofing and heat insulating materials not only increases the cost of the block, but also significantly increases the cost of construction, since it is necessary to spend additional time applying these materials.

SUMMARY OF THE INVENTION

The present invention overcomes the disadvantages of the prior art blocks by providing a block which has chambers formed therein and filling these chambers with a foaming agent which comprises a light-weight heat insulator and moisture-proof material. This material is merely placed in the chamber portion of the block and then allowed to foam thereby taking on its heat insulator and moisture-proof characteristics. Thus, it is unnecessary to apply the additional layers to the exterior of the blocks.

Another important feature of the present invention is the formation of grooves on one edge of each partition of the blocks. These grooves allow the insertion of a pipe through the block so that the end of the pipe can be positioned within each chamber. Thus, the invention includes the structure necessary to provide a very simple technique for filling the chambers with the light-weight insulator and moisture-proof material.

Still another feature of the disclosed invention is the provision of a pipe in the groove in the partitions of the block. This pipe is of a larger diameter than the pipe which is used to insert the heat insulator and moisture-proof material in the chambers, and thus, the insertion pipe is inserted into the pipes in the groove. The pipe in the groove prevents the insertion pipe from contacting the periphery of the groove and possibly damaging the periphery of the groove.

Thus, the present invention provides an architectural block which includes the necessary structure for permitting the insertion of a foaming agent comprising a light-weight heat insulator and moisture-proof material into chambers formed within the block. This overcomes the disadvantages in prior art blocks which require layers of moisture-proof material and heat insulator material on the exterior thereof.

DETAILED DESCRIPTION OF THE PREFERRED EMBODIMENT

Figure 1:
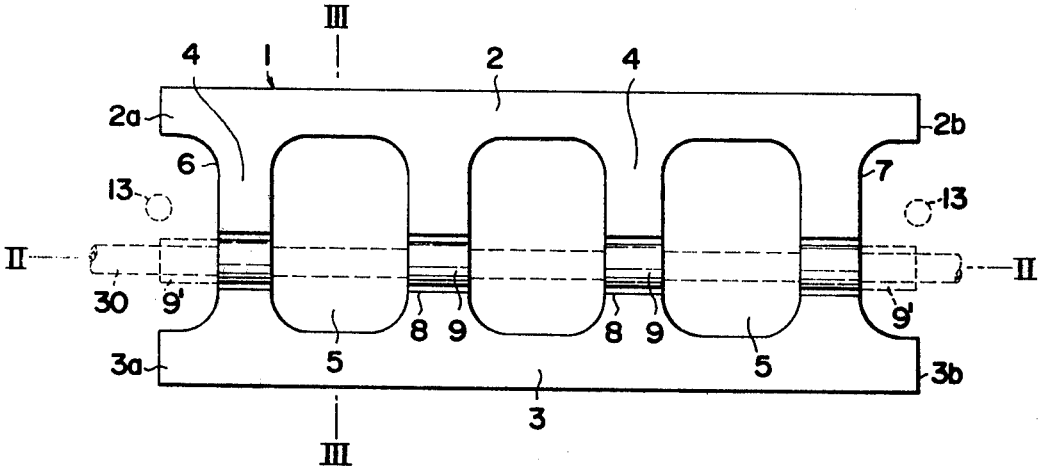
FIG. 1 is the plan of principal block 1, according to the present invention.
Figure 5:
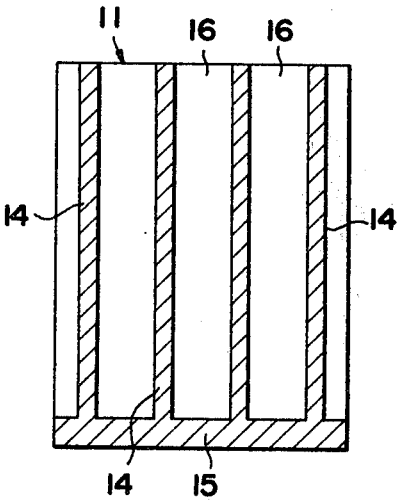
FIG. 5 is a cross-sectional view of an accessory block having a cover plate.

Referring to the drawings, the blocks are generally incorporated together with concrete and have the form of a square box. As shown in FIGS. 1–4, a principal block 1 is so formed that the space between two lateral walls 2, 3 is divided by a plurality of partition walls 4 having the same height as said lateral walls to define compartments or chambers 5 passing through from the top to the bottom of said block. Both lateral sides of said block having projected end portions **2*a*, 2*b* and 3*a*, 3*b* of said lateral walls 2, 3, the projected end portions forming grooves or recesses 6 and 7. The top surfaces of said partitions are provided with a linear groove 8 and a pipe 9 fixed in groove 8. The pipe 9 has a length of substantially the same length as the thickness of said partition. As shown in FIG. 1, the vertical grooves 6, 7 on the both lateral sides are penetrated by reinforcement steel bars 13 and filled with mortar. Furthermore, they are preferably penetrated with prolonged pipes 9'. Numerals 11 and 12 in FIGS. 5 and 6 denote accessory blocks. A block 11 in FIG. 5 has a structure similar to that of said principal block 1 but is partitioned with a wall having no groove 8. One side of chamber 16 has a cover plate 15 of the bottom. A block 12 in FIG. 6 has a structure similar to that of said principal block 1 but is partitioned by a wall 17 without a groove 8. Hole 18** passes through the block.

Figure 6:
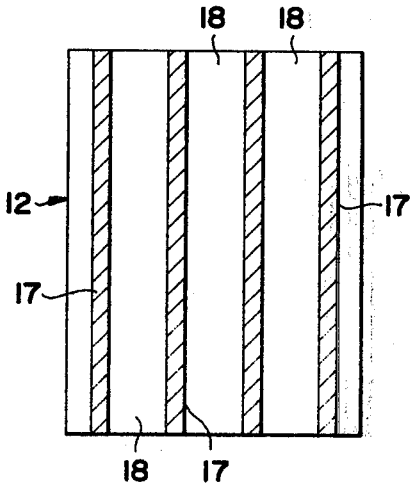
FIG. 6 is a cross-sectional view of an accessory block having through holes therein.
Figure 4:
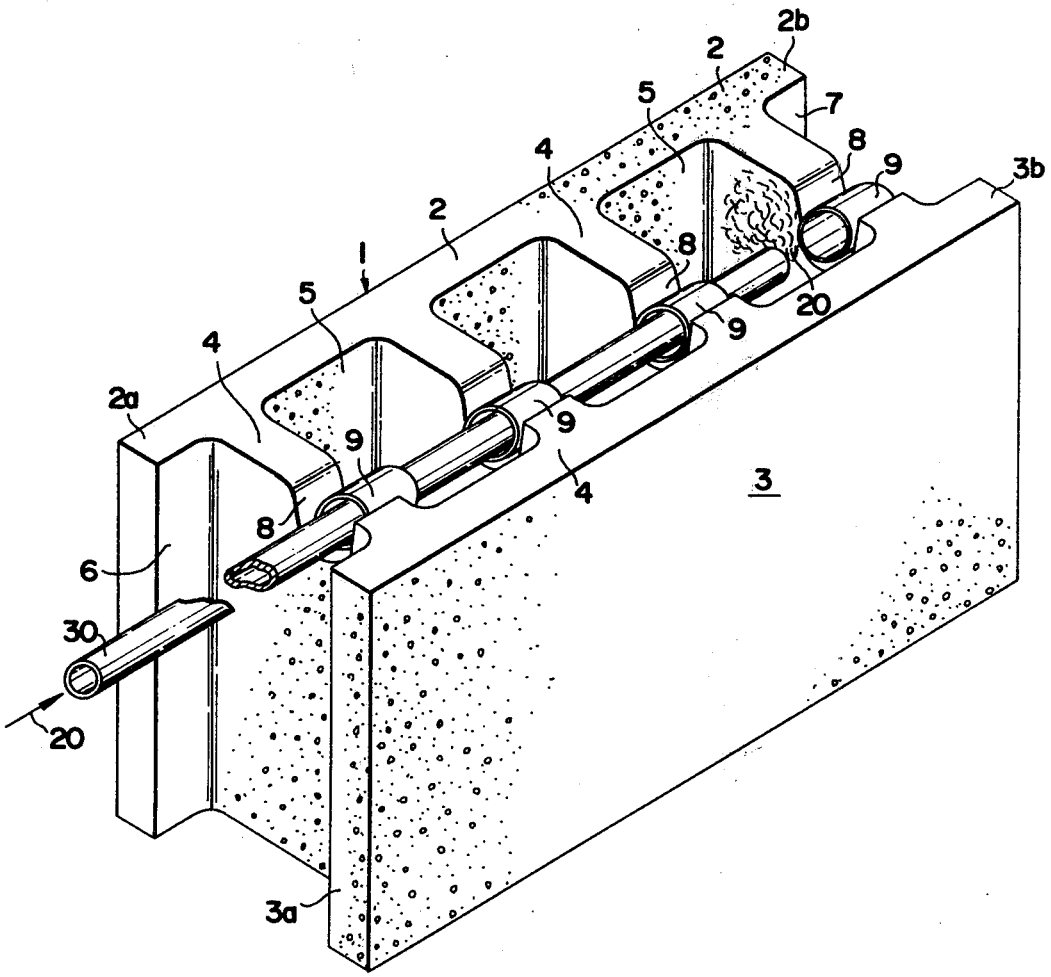
FIG. 4 is a perspective view thereof.

Among the blocks as described above, the principal block 1 and accessory block 11 are necessary for the construction of an architectural structure, but the accessory block 12 in FIG. 6 is occasionally employed in a convenient combination according to the structure.

Figure 2:
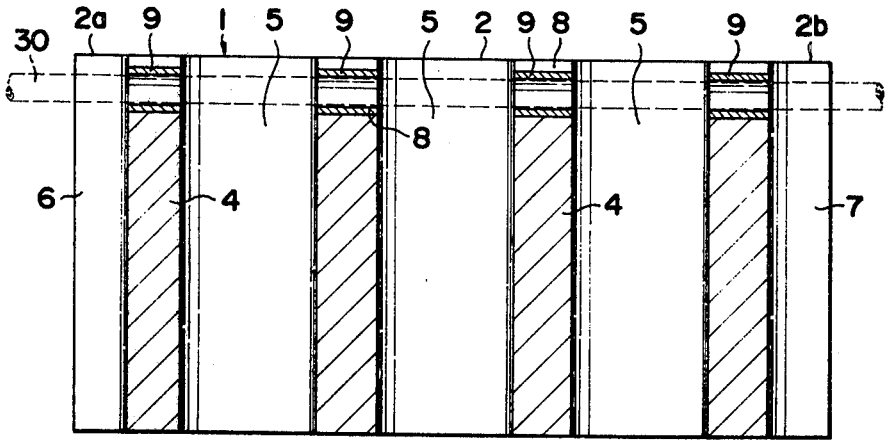
FIG. 2 is the fragmentary elevation along line II—II in FIG. 1.
Figure 3:
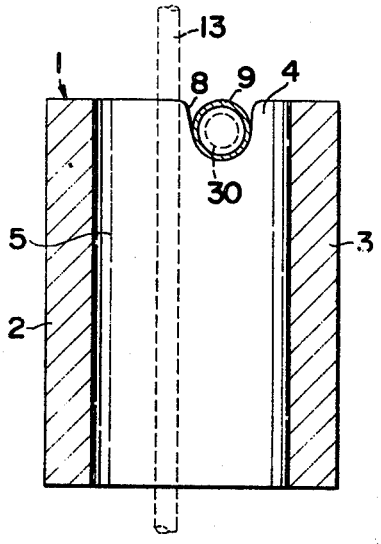
FIG. 3 is a cross sectional view along line III—III of FIG. 1.
Figure 7:
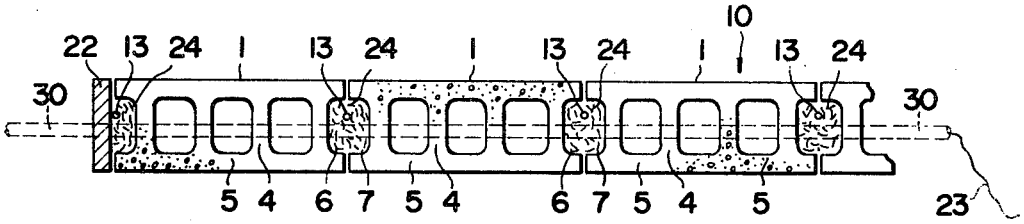
FIG. 7 is a partial plan of a structure (wall or floor) composed of principal blocks jointed in series.
Figure 8:
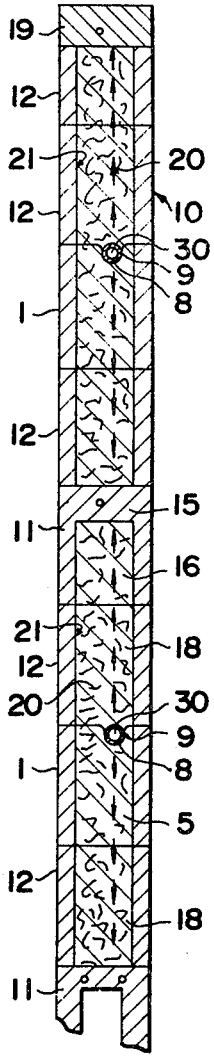
FIG. 8 is a partial longitudinal cross-sectional view of the structure constructed of the blocks of the present invention.

FIGS. 7 and 8 show the portions for forming the walls and floor of structure 10 constructed with these blocks. FIG. 7 is a plan view of the foundation structure of combined blocks, while FIG. 8 is the longitudinal view thereof, which foundation structure is employable both for wall and floor. As shown in FIG. 7, the structure is so built that the chamber 5 may be positioned vertical or jointed horizontally as shown in FIG. 2 to construct the base for the fundamental structure, and then, as shown in FIG. 8, blocks 12 are placed over and under the principal block 1 so that the chamber 18 of block 12 may pass through on the both sides of the chamber 5 of block 1. When further the blocks 11 having cover plates 15 are overlaid jointly, the chambers of three blocks are covered with said cover plate 15 to define a chamber 21. This chamber may also be covered with a block plate 19 in place of said block 11 having the cover plate 15. When a chamber 21 has been defined in this manner, the injection pipes 30 are inserted, as shown in FIGS. 1–4, into different pipes 9 disposed along linear lines in different partitions 4 of block 1.

The composition 20 comprising a blowing agent-containing synthetic resin mixed with glass fiber, asbestos and other inorganic lightweight insulating and moisture-proof materials is injected from said injection pipe 30 by an air stream. After one chamber is filled, the injection pipe 30 is withdrawn and inserted into another chamber to inject the composition.

For the purpose of injection, an injection pipe may be placed directly in a groove 8 whether or not a pipe 9 is used, but the pipe 9 may preferably be employed because the grooved walls may be broken and the smooth insertion of the injection pipe could be interrupted.

After the whole cavity of said block is filled with said composition, the blowing agent in the composition generates foam owing to the natural drying, and the expanded mass containing the insulating and moisture-proof materials fills the chambers of each block. A piece of string is attached to the end of injection pipe 30 and kept outside the block. The string is pulled after the complete withdrawal of injection pipe 30 and is pulled out after the insertion of injection pipe 30. Thus, the expanded mass if bored to form an orifice, which serves to aerate the expanded foam and to prevent it from hardening. The outmost orifice is usually closed with a stopper. When the effectiveness of expanded mass has been reduced after the use of a long period, the injection pipe 30 may be pulled through to let the fresh composition set up the expanded mass. The vertical grooves 6, 7 are penetrated by a reinforcing bar 13 and filled with mortar 24, thus being reinforced. An oblong cover plate 22 is mounted to the end of the reinforcement portion.

According to the present invention, since the hollows in the blocks are filled with heat insulator and moisture-proof material, the structures constructed with said blocks maintain coolness in summer and warmth in the winter within the interior.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than the foregoing description, and all changes which come within the meaning and range of equivalency of the claims are therefore to be embraced therein.

I claim:

1. An architectural block comprising:

a. two opposed side walls;

b. at least two parallel partitions positioned between said side walls perpendicular thereto, said partitions and side walls defining chambers within said block;

c. groove means, formed in one edge of each of said partitions, for receiving therethrough a hollow pipe means for carrying a foamable synthetic resin composition into said chambers from the exterior of said block; and d. a pipe means in each of said groove means for preventing damage to the portion of said partition on the periphery of said groove means, said hollow pipe means passing through the interior of said pipe means when it is received through said groove means.

2. The block of claim 1, wherein said block is concrete.

3. The block of claim 1, wherein said block has the shape of a rectangular solid.

4. The block of claim 1, wherein a recess is formed between the end portions of said side walls and at least one of said partitions.

5. The block of claim 1 wherein said chambers are filled with said foamable synthetic resin.

6. A structural member including a plurality of architectural blocks, said member comprising:

a. a plurality of blocks aligned in at least one row, each block including two opposed side walls, at least two parallel partitions between said side walls and perpendicular thereto, said partitions and side walls defining chambers within said block and groove means, formed in one edge of each of said partitions, wherein the groove means in each row of said blocks are aligned with each other, said groove means having a removable hollow pipe means therethrough for carrying a foamable synthetic resin composition into said chambers from the exterior of said block during the construction of said wall;

b. cover plate means extending between the outside ends of the first blocks at the end of each said row; and c. a foamable synthetic resin composition within said chambers, said composition comprising a lightweight heat insulator and moisture proof material.

7. The structural m ember of claim 6, wherein each block is concrete.

8. The structural member of claim 6, wherein each block has the shape of a rectangular solid.

9. The structural member of claim 6, further including a pipe means in each of said groove means for preventing damage to the portion of said partition of the periphery of said groove means, said hollow pipe means passing through the interior of said pipe.

10. The structural member of claim 6, wherein a recess is formed between the end portions of said side walls and at least one of said partitions.

* * * * *